United States Patent [19]

Kolt

[11] Patent Number: 4,501,389

[45] Date of Patent: Feb. 26, 1985

[54] AUTOMATIC DAMPER ASSEMBLY

[75] Inventor: Stanley Kolt, Mamaroneck, N.Y.

[73] Assignee: Leonard W. Suroff, Jericho, N.Y. ; a part interest

[21] Appl. No.: 504,179

[22] Filed: Jun. 14, 1983

Related U.S. Application Data

[63] Continuation of Ser. No. 313,345, Oct. 20, 1981, Pat. No. 4,416,415.

[51] Int. Cl.[3] ..... F24F 13/16

[52] U.S. Cl. ..... 236/49; 98/116

[58] Field of Search ..... 236/45, 49, 92 R, 92 C; 98/40 VT, 43 R, 43 C, 72, 116; 137/601

[56] References Cited

U.S. PATENT DOCUMENTS

| | | | |
|---|---|---|---|
| 3,311,302 | 3/1967 | Merckle | 236/45 |
| 3,378,065 | 4/1968 | Mitchell et al. | 98/116 X |
| 3,976,245 | 8/1976 | Cole | 236/93 A |
| 4,416,415 | 11/1983 | Kolt | 236/49 |

*Primary Examiner*—William E. Tapolcai

*Attorney, Agent, or Firm*—Leonard W. Suroff

[57] ABSTRACT

An automatic temperature and pressure responsive damper assembly for use within the conduit of a ventilating system designed to exhaust the air from a confined space to the atmosphere when the confined space reaches a preselected temperature or when the pressure in the confined space is greater than that in the conduit adjacent to the atmosphere. The damper assembly includes at least one vane pivotally mounted within the conduit, preferably two, the vane or vanes being mounted so that they are movable between a generally opened position, wherein air can pass freely through the conduit, and a generally closed position, wherein air passage through the conduit is blocked. A temperature responsive drive assembly that detects the temperature within the conduit is mounted therein and acts upon the vane or vanes is provided such that a change in temperature and expansion of the temperature responsive drive assembly causes the vanes to move to their opened position. Biasing means are provided for urging the vane or vanes when subjected to the aforementioned differential in pressure to their normally closed position.

2 Claims, 6 Drawing Figures

AUTOMATIC DAMPER ASSEMBLY

This application is a continuation of application Ser. No. 313,345, filed Oct. 20, 1981, now U.S. Pat. No. 4,416,415.

BACKGROUND OF THE INVENTION

1. Field of the Invention

The present invention is directed generally to a ventilation conduit damper assembly for use in a variety of angular mounted positions. More specifically, the present invention is directed to such a ventilation damper assembly provided with automatic temperature and pressure responsive actuating means whereby the amount of movement of the damper vane or vanes, over a preselected temperature and/or pressure range, is controlled and the vane or vanes will automatically close whether mounted in a vertical or horizontal plane or any plane therebetween.

2. Description of the Prior Art

Dampers for use in air conduits or ducts are generally well known and typically a damper assembly will consist of a movable vane or vanes which are positionable to control the amount of air flow through the conduit within which the damper is placed. Dampers are additionally often used in conjunction with ventilating systems in private homes and other buildings where it is desired to provide a measure of ventilation control.

In some areas of the country, where rather hot weather is experienced during at least a portion of the year, it is often desirable to provide a means for ventilating an otherwise confined portion of a building, for example, the attic in a private home, in order to minimize the buildup therein of excess heat and/or humidity. This ventilation is often provided by the use of a turbine air ventilator of a well known type in which wind causes the turbine blades to rotate, producing in effect a pumping action, assisting the air flow out of the area provided with the ventilating conduit.

While turbine ventilation systems are quite effective in promoting air flow, they have, in the past, suffered from the lack of an effective automatic means to control the amount of air removed. Obviously, the air flow should be at a maximum during hot weather when the temperature of the air to be ventilated is high, but just as obviously the ventilation should be much less when the temperature in the air to be ventilated is lower. Unnecessary ventilation during periods of cool temperatures may contribute to excess losses of heat and consequent increases in heating costs. While this problem of present ventilation systems is recognized, there had been no solution until the appearance of U.S. Pat. No. 4,123,001 issued to Stanley Kolt on Oct. 31, 1978. This device provides an automatic ventilator which permits ventilation during the heat buildup in a confined space, usually an attic. Prior to this invention by the same inventor as the present invention, the prior automatic adjustable dampers which had been contemplated or manufactured, as for example those disclosed in U.S. Pat. Nos. 1,737,054; 3,921,900; and 3,976,245 had been unable, under certain conditions of positionment, to perform their desired function in an effective manner, in that the angle in which they can operate is limited. Since it was recognized that there are numerous applications in which it would be desirable to mount a damper in other than a horizontal plane, the prior invention by the present inventor solved this problem. It now has become recognized that there are certain situations in which it is desirable to open the dampers in a conduit automatically regardless of overtaking even if the confined space has not reached or is not at the proper opening temperature.

Circumstances when such opening is desired can basically be attributed to situations when there is a pressure buildup in a confined space. For instance, it is quite commonplace to have a so-called whole house fan installed between the upper ceiling of the top story of a dwelling and the attic thereof. This fan sucks warm air out of the top story of the house and pumps it into the attic. Frequently, there is a back pressure built up in the attic attributable to the whole house fan which cannot be vented by a conventional temperature actuated damper because the attic does not reach the necessary temperature to trip the temperature responsive mechanism of the damper. When there is such a pressure buildup inside an attic, as a result of the use of the whole house fan either for cooling or more likely for general ventilation purposes such as when it is desirable to vent smoke or stale air from the house, the prior art will not permit exhausting of the attic air. In contrast, the present invention is configured such that this buildup in pressure will force the damper vanes of the present invention open so that ventilation can be accomplished.

The present invention has application for use in a flu such as in a heating system with solid, gaseous, or liquid fuels. For example, at the outlet or within a fireplace chimney or conventional home or industrial heating unit.

Another instance where opening of a damper in response to a differential in pressure is desirable is where a driven fan or turbine is disposed on the outer end of a ventilation conduit adjacent to the atmosphere. When this fan or turbine is activated for ventilation purposes, if the air within the attic is not hot enough to cause the temperature responsive mechanism to be triggered, no air can be withdrawn from the attic. In contrast, activation of such a fan or turbine, when used in conjunction with the present invention, will cause the vanes thereof to be sucked opened as a result of the pressure drop between the vanes and the fan this pressure drop having caused the ambient pressure in the attic once again to be greater than that in the conduit adjacent to the exhaust half thereof.

Additionally, if sufficient air flow is caused through a conduit by any means, a cooling effect can take place at a temperature actuated damper disposed therein and even though the confined space, such as an attic, is at a temperature sufficient to open the damper vane, the vane will remain closed. Such is not the case with the present invention since an air flow itself will cause opening of the damper thereof.

Therefore, the present invention overcomes the problems associated with the prior art by providing an automatic pressure and temperature responsive damper for use in a ventilation system wherein the damper can be opened in response to a preselected temperature or a preselected pressure.

OBJECTS OF THE INVENTION

An object of the present invention is to provide an automatic damper assembly for use in home and industrial ventilating systems.

Another object of the present invention is to provide an automatic damper which requires no attention and which may be mounted in either a vertical or horizontal plane or any plane therebetween.

Another object of the present invention is to provide an automatic damper assembly which has at least one vane damper positioned in an air flow conduit, the vane damper being automatically forced to a closed position when mounted in a vertical plane, horizontal plane, or any plane therebetween.

A further object of the present invention is to provide an automatic vane damper assembly which opens automatically when subjected to a preselected temperature.

Still another object of the present invention is to provide an automatic vane damper assembly which opens automatically in response to a differential in pressure across the conduit in which it is mounted regardless of the temperature of the conduit.

An additional object of the present invention is to provide an automatic damper assembly which can be readily adapted for use in a conventional conduit.

A still additional object of the present invention is to provide an automatic damper assembly which can be used in conjunction with a motor driven fan or turbine or the like.

A still further additional object of the present invention is to provide an automatic damper assembly which can be used in conjunction with a wind driven turbine.

Still another object of the present invention is to provide an automatic damper assembly which is simple in design, inexpensive to manufacture, rugged in construction, and efficient in operation.

Other objects and advantages of the present invention will become apparent as the disclosure proceeds.

SUMMARY OF THE INVENTION

An automatic pressure and temperature responsive ventilation system which incorporates a temperature and pressure responsive damper for use within a conduit extending between a defined confined space and the atmosphere wherein the damper is opened in order to minimize excess heat buildup in the confined space and is closed when it is desired to prevent heat loss from the confined space. The damper is also opened when there is a pressure buildup within the confined spaced or an induced lowering of pressure between the exhaust of the conduit and the surrounding atmosphere. The damper assembly includes at least one vane, preferably two, pivotally mounted in the conduit so as to be movable between a generally opened position wherein air is permitted to pass through the conduit and a generally closed position where passage of air through the conduit is precluded.

A camming means is secured to the vane or each of the vanes and includes a camming surface thereon. A temperature responsive drive assembly is mounted within the conduit to detect temperature changes therein and is adapted to actuate in response to such temperature changes within a predetermined range. The movement of the temperature responsive drive assembly, upon a change in temperature, acts upon the camming surfaces through a transmission means which extends therebetween.

A biasing means is provided for urging the camming means into contact with the transmission means in a direction to cause automatic closing of the vane or vanes irrespective of the mounted position of the conduit. This overcomes the drawbacks of the prior art in which the vanes could possibly stick in their opened positions. Additionally, the biasing means permits movement of the vane or vanes when subjected to a differential in pressure overcoming the limitations of the prior art wherein the damper could not be opened when desired because of increased pressure conditions unless the proper temperature condition was also met.

Due to the completely automatic nature of the present invention, no attention is required on the part of the user. The damper operates automatically over the preselected temperature and preselected pressure ranges opening and closing in response to variations in these parameters, thus assuring even the most forgetful user that proper ventilation is taking place. The apparatus of the present invention may be positioned at the most advantageous portion of the flow conduit with no necessity for concerning oneself if it is to be vertically or horizontally mounted in position.

The preferred temperature-sensitive bellows power unit which causes the movement of the transmission means to effect opening and closing of the damper is of a well known design. One feature of these units is that they can be manufactured to operate over a number of desirable temperature ranges. A bellows unit with the desired temperature sensitivity is chosen and installed in the assembly to cause the damper to open and close over the desired range. Abnormally low temperatures will not adversely affect the performance of such a power unit since once the temperature falls below the range of the bellows, further temperature decreases will have no effect. Abnormally high temperatures on the other hand do cause the bellows unit to continue to expand to some degree.

However, with the preferred embodiment, this will not harm the damper mechanism of the present invention. The camming surfaces on the camming means are so shaped as to slide over the surface of the transmission means and closing of the vanes is aided by the biasing means which urges the vanes into their closed position. Hence, the present assembly, unlike most previously attempted automatic dampers, is efficient, reliable, unharmed by temperature fluctuations in excess of those designed for, completely automatic, capable of insertion into existing conduits, low in cost, and moutable at various angles of inclination. Additionally, the present invention, through judicious selection and configuration of the biasing means thereof, is configured such that a differential in pressure across the vane or vanes thereof will cause the vanes to be either pushed or sucked opened permitting ventilation even in circumstances wherein the temperature necessary to activate the temperature responsive drive assembly is not reached.

BRIEF DESCRIPTION OF THE DRAWINGS

Although the characteristic features of the invention will be particularly pointed out in the Claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWING

Figure 1:
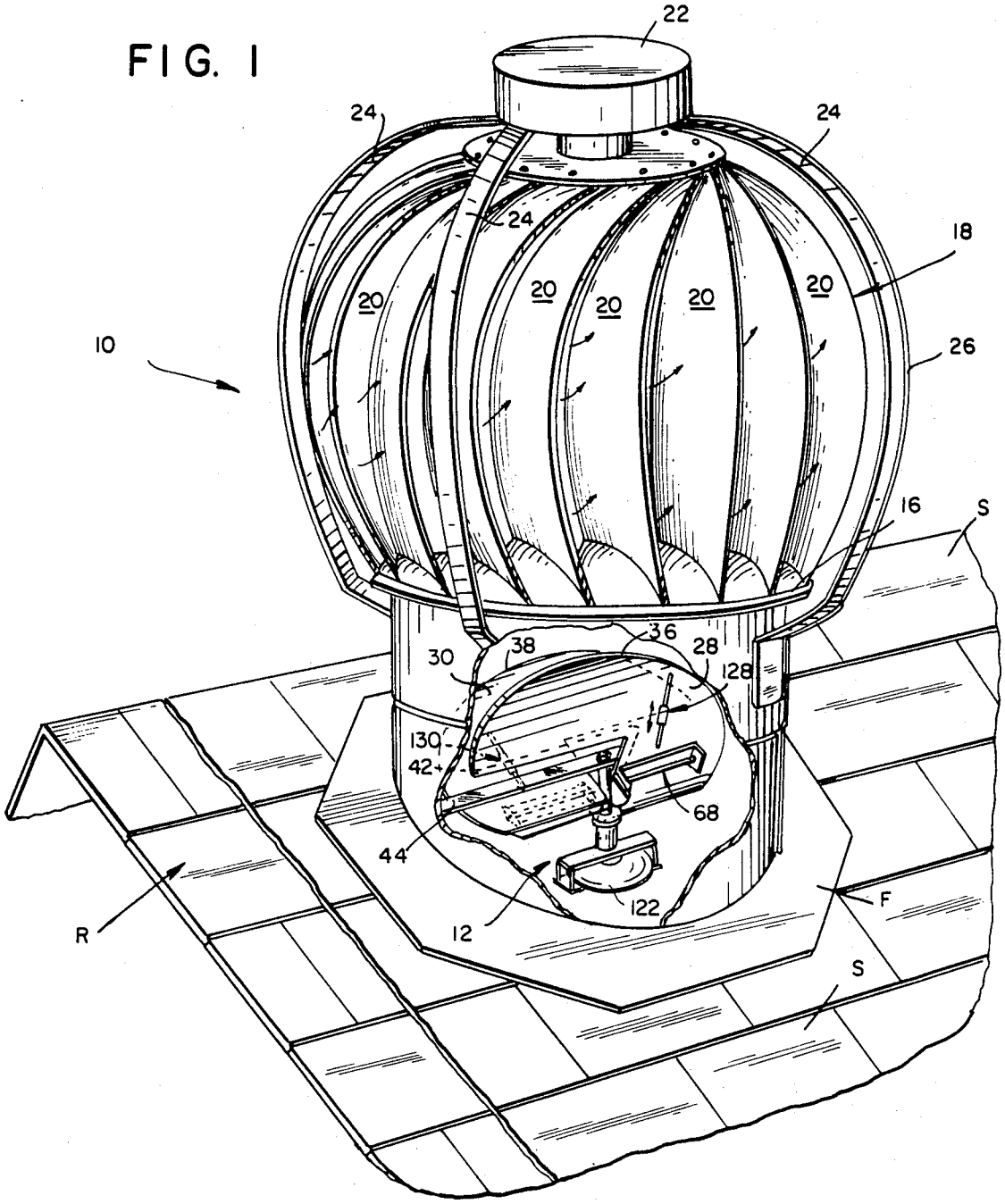
FIG. 1 is a perspective view of an automatic pressure and temperature responsive ventilation system constructed in accordance with the principles of the present invention.

Referring now to the figures, and more particularly to FIG. 1 thereof, there is illustrated therein an automatic pressure and temperature responsive ventilation system 10 which incorporates a pressure and temperature responsive damper assembly 12. The ventilation system 10 is mounted on a typical roof R by means of a conduit 14 suitably flashed by flashing F covering the shingles S of roof R adjacent to the conduit 14. At the upper end 16 of the conduit 14, there is mounted a wind driven tubine assembly 18. The wind driven turbine assembly 18 is of a conventional type and includes a plurality of wind catching blades 20. Aside from being drivable by the wind, the turbine 18 can also be driven by a motor 22, which is electrically powered and which is mounted by a plurality of supports 24. Extending from the motor housing 22 is a cable 26 which provides electrical power to the motor 22 as desired.

Figure 4:
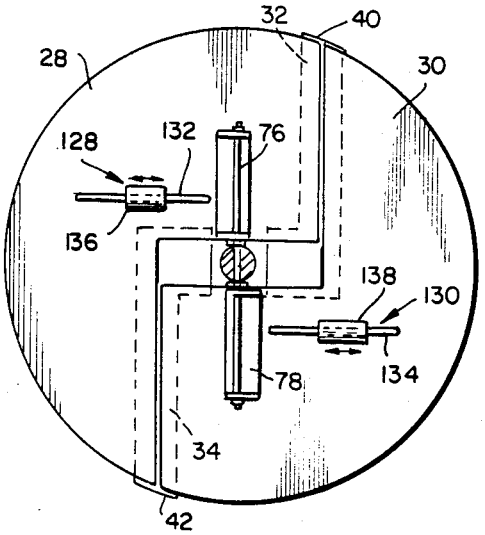
FIG. 4 is a cross sectional view of the assembly of FIG. 2 taken substantially from the lines 4—4 thereof.

Within the conduit 14, the damper assembly 12 includes a pair of vanes 28 and 30 each having, respectively, an inner edge 32 and 34, and respectively, outer edges 36 and 38. The outer edges 36 and 38 of the vanes 28 and 30 are in substantially conforming relationship to the inner circumference or curvature of the conduit 14. In this manner, when the vanes 28 and 30 are in a closed position as illustrated in FIG. 4, there is a minimum spacing between the outer edges 36 and 38 and the conduit 14. In addition, sealing lips 40 and 42 are fixedly secured, respectively, to inner edges 32 and 34 of vanes 28 and 30, the sealing lips 40 and 42 contacting the adjacent vane to seal the space between the inner edges 32 and 34 thereof when in a closed position.

The vanes 28 and 30 can be fabricated from metal, plastic, or the like.

Figure 2:
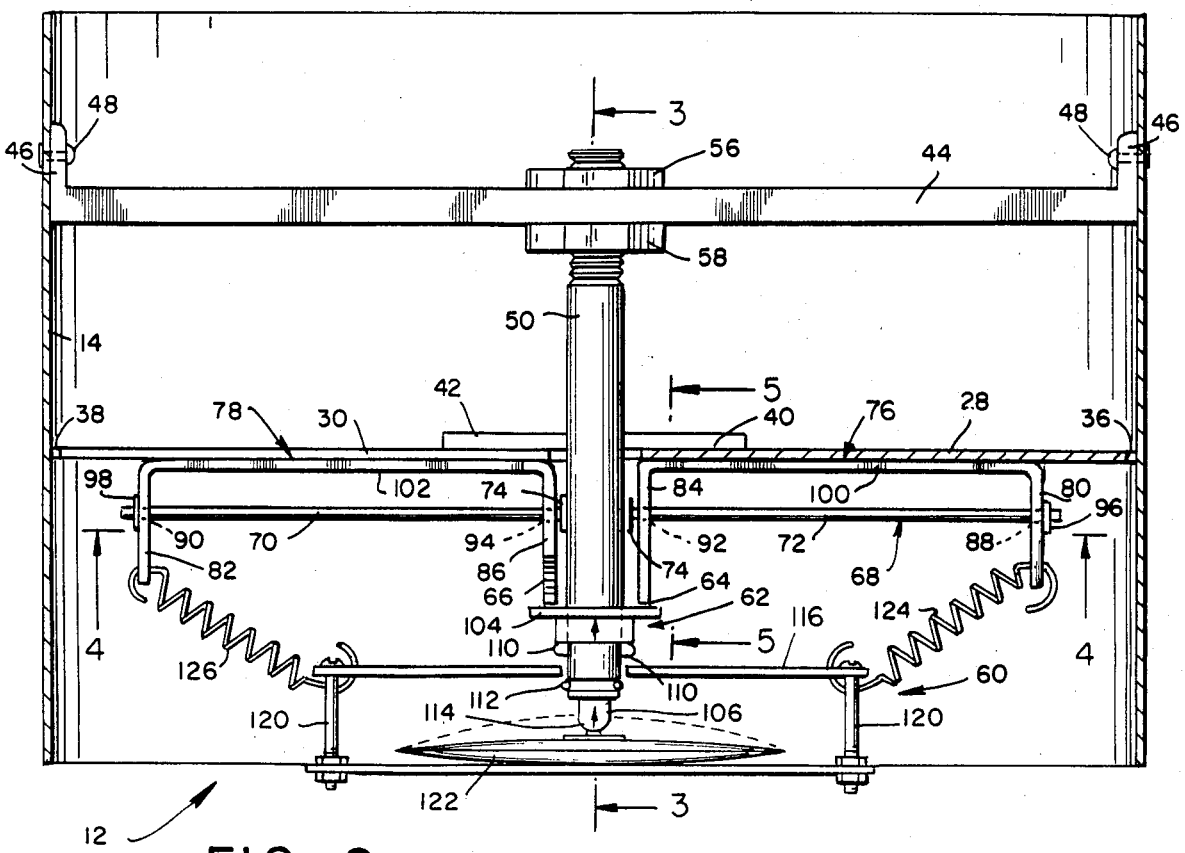
FIG. 2 is a fragmentary cross sectional view of the ventilation system of FIG. 1.
Figure 3:
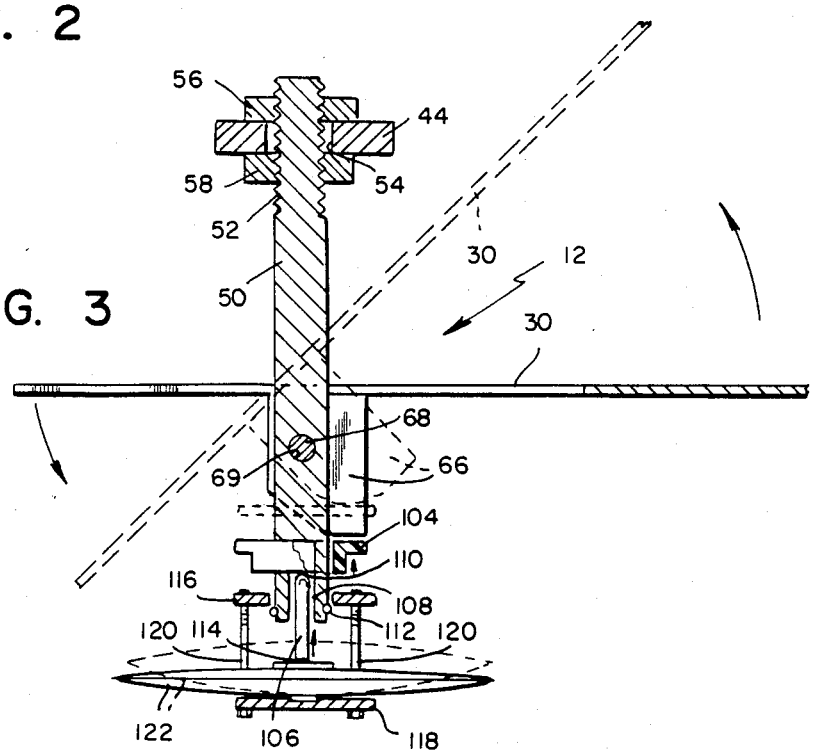
FIG. 3 is a cross sectional view of the assembly of FIGS. 1 and 2 taken substantially through the lines 3—3 of FIG. 2.

With reference to FIG. 2, the manner in which the damper assembly 12 is mounted within the conduit 14 can be observed. The damper assembly 12 is secured to the conduit by a mounting bracket 44. The mounting bracket 44 includes flanges 46 disposed at the ends thereof which are fixedly secured by fasteners 48 to the wall of the conduit 14. The fasteners 48 may be screws, rivets, or the like. Suspended from the mounting bracket 44 is a cylindrical housing 50 which includes a plurality of threads 52 adjacent to one end thereof. The mounting bracket 44 has an aperture 54 disposed therethrough, as illustrated in FIG. 3. Threads 52 extend through the aperture 54 and are engaged on either side of the mounting bracket 44 by a pair of nuts 56 and 58 which tightly clamp the mounting bracket 44 therebetween.

The cylindrical housing 50 serves to mount a temperature responsive assembly 60 at the other end thereof and also houses the transmission assembly 62, as hereinafter described, which transfers forces from the temperature responsive assembly 60 to the vanes 28 and 30 through camming members 64 and 66 associated, respectively, with vanes 28 and 30 as further described hereinafter.

A shaft 68 is disposed through an aperture 69 located in the cylindrical housing 50 as further illustrated in FIG. 3. The housing effectively divides the shaft 68 into a first section 70 and a second section 72. The shaft 68 is retained in position relative to the cylindrical housing 50 by a pair of retaining washers 74 which each frictionally engage the shaft 68.

The vanes 28 and 30 are mounted to the shaft sections 70 and 72 by a pair of unitary members 76 and 78, associated, respectively, with the vanes 28 and 30. The unitary members 76 and 78 each provide at the ends thereof, respectively, upstanding substantially perpendicular ears 80 and 82, and 84 and 86. The ears 80, 82, 84, and 86 have disposed therethrough, respectively, apertures 88, 90, 92, and 94. The section 70 extends through the apertures 88 and 92 and the shaft section 72 extend through the apertures 82 and 86, the apertures 88, 90, 92, and 94 being dimensioned to permit the journaling of the unitary members 76 and 78 in respect to the shaft 60. The unitary member 76 is retained on the shaft section 70 by locking washer 96 and the unitary member 78 is retained on the shaft section 72 by a locking washer 98.

Figure 6:
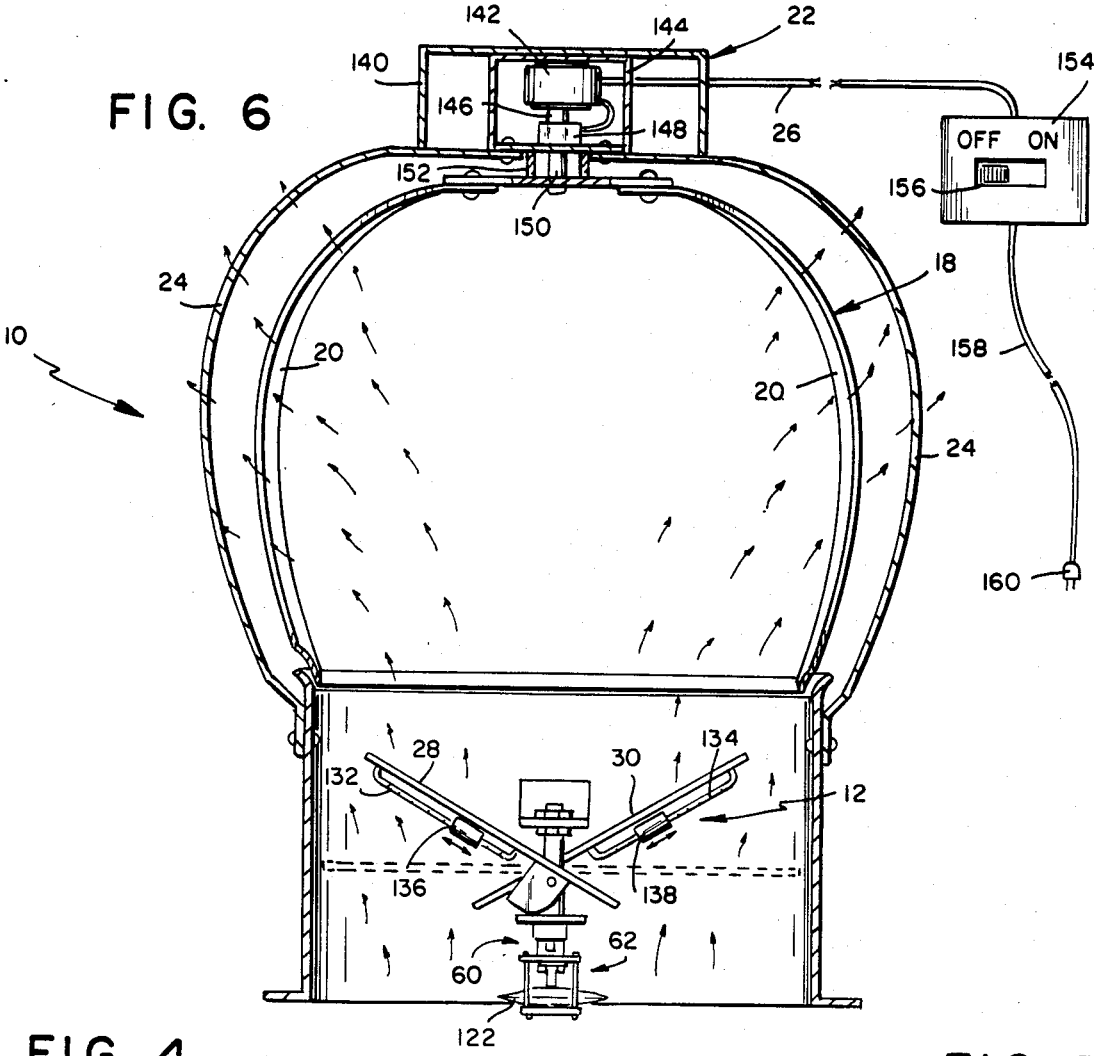
FIG. 6 is a side cross sectional view of the embodiment of FIG. 1.
Figure 5:
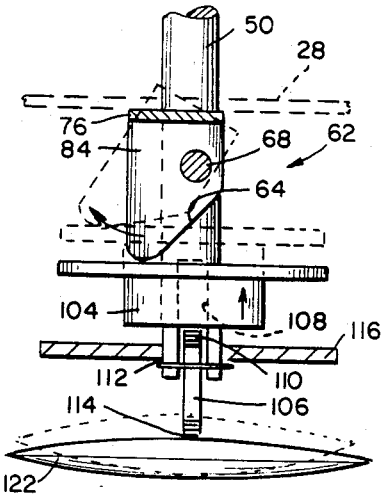
FIG. 5 is a cross sectional view taken substantially from the lines 5—5 of FIG. 2.

The body of the unitary members 76 and 78 is formed, respectively, by base portions 100 and 102 each which are fixedly secured, respectively, to the vanes 28 and 30. The ears 84 and 86, incorporate, respectively, the camming surfaces 64 and 66. As a result, when force is placed on these camming surfaces by the reciprocating collar 104, an element of the transmission means 62, the vanes 28 and 30 are pivoted into an open position as illustrated in FIGS. 1, 3, 5, and 6. The camming surfaces 64 and 66 are rounded on their ends as illustrated in FIGS. 5 and 6 and are inclined at opposing angles in respect to each other to cause the vanes 28 and 30 to open in opposite directions as illustrated.

The balance of the transmission assembly 62 includes a reciprocating member 104 which reciprocates coaxially in a hollow slotted portion or channel 108 of the cylindrical housing 50 and which includes a disc shaped head. The reciprocating member 106 provides a pair of protrusions 110 which extend out of the hollow slotted portion 108 and which contact the lowermost edge of the reciprocating collar 104. The reciprocating member 106 is retained within the hollow portion 108 of the cylindrical housing 50 by a retaining ring 112 which frictionally engages the cylindrical housing 50. When pressure is placed on the rounded end 114 of the reciprocating member 106, it transfers such force through the protrusions 110 to the reciprocating collar 104 which in turn places force on the camming surfaces 64 and 66, opening the vanes 28 and 30. The opening of vane 30 is illustrated in phantom in FIG. 3 and the opening of vane 28 is illustrated in phantom in FIG. 5.

With reference to FIGS. 2 and 3, the temperature responsive assembly 60 can be seen to comprise a top plate 116 and a bottom plate 118 separated by a plurality of posts 120. The posts 120 may be variously configured and serve merely to keep the top plate 116 and the bottom plate 118 in a spaced apart relationship. The end of the cylindrical housing 50 extends through an aperture in the top plate 116, the retaining ring 112 keeping the top plate 116 on the housing 50. Disposed between the top plate 116 and the bottom plate 118 is a sealed bellows power drive unit 122. The sealed bellows power drive unit 122 serves as a thermal power source which, in conjunction with the balance of the structure of the temperature responsive assembly 60 provides the necessary force, under thermal influence, to open the vanes 28 and 30.

The sealed bellows power drive unit 122 is of a conventional design and is filled with a heat expansible fluid, the volatility of which is matched along with the shell thickness, type of metal and volume of the unit, to provide a suitable expansion at the desired temperature range. In addition to being actuated at the appropriate design temperature, the power drive unit 122 of the present invention should also be capable of generating a force in the range of about 50 to 60 pounds per square inch in order to be operable to move the damper vanes 28 and 30. It will be understood that any of a number of temperature sensitive power drive units may be utilized in the temperature responsive assembly 60 so long as their expansion and contraction characteristics are predictable and the force generated is suitable over the desired temperature range.

Accordingly, the bellows power drive unit 122 is capable of expanding and contracting in response to temperature changes between predetermined limits and to generate a force upon expansion. Expansion of the unit 122 is illustrated in phantom in FIGS. 2 and 3. The bellows power drive unit 122 is fixedly secured to the bottom plate 118 so that the opposite end thereof can exert a force upon the reciprocating member 106 at the rounded end 114 thereof, said end 114 making point contact with said power drive unit 122.

To keep the camming surfaces 64 and 66 in contact with the reciprocating collar 104, a pair of helical tension springs 124 and 126 are provided. The spring 124 is fixedly secured on one end thereof to the ear 80 and on the other end thereof to the top plate 116. Similarly, the spring 126 is fixedly secured on one end thereof to the ear 82 and on the other end thereof to the top plate 116. The ends of the springs 124 and 126 can be disposed through apertures as illustrated or can be connected in another suitable manner. Helical tension springs 124 and 126 apply a pulling or tensioning force respectively on the unitary members 76 and 78, in a manner which causes them to rotate to a rest or closed position as illustrated in FIGS. 2 and 4.

The force provided by the springs 124 and 126 acts upon the unitary members 76 and 78 in a manner which causes them to rotate about the shaft 68, as a result of the point of attachment of the springs 124 and 126 to the ears 96 and 98 being radially displaced from the longitudinal axis of the shaft 68, as illustrated in FIG. 4. In particular, the springs are disposed so that they engage the ears 96 and 98 at a point radially spaced and below the shaft 68. The springs 124 and 126 apply a force sufficient to keep the vanes 28 and 30 in a closed position regardless of the orientation of the bracket 44 relative to the conduit 14 or the orientation of the conduit 14, but are of a force which will permit the opening of the vanes 28 and 30 when subjected to a pressure differential as hereinbefore described. Suitable biasing means other than the springs 124 and 126 may be employed so long as the force requirements described are selected to fit the necessary criteria.

To further regulate the amount of draft or pressure differential necessary to open the vanes 28 and 30, a pair of adjustment weight assemblies 128 and 130, fixedly secured, respectively, to vanes 28 and 30, as illustrated in FIGS. 1, 4, and 6, are provided. The weight assemblies 128 and 130 each comprise respectively a substantially C-shaped member, 132 and 134, fixedly secured on the ends thereof to the vanes 28 and 30. Weights 136 and 138 which are frictionally positionable respectively, on the C-members, 132 and 134, are provided and can be slid therealong to change the amount of force necessary to open the vanes 28 and 30. This occurs since the C-shaped members 132 and 134 are oriented such that moving the weights 136 and 138 therealong causes the weights 136 and 138 to move either closer to or away from the shaft 68 on which the members 28 and 30 pivot. The downward force provided by these weights therefore varies in direct proportion to the distance the weights 136 and 138 are disposed from the shaft 68. If it is required that the vanes 28 and 30 open at high pressures only, the weights would be disposed far away from the shaft 68 and, if it is desired that the vanes 28 and 30 open at low pressures, the weights 136 and 138 would be disposed close to the shaft 68.

Referring to FIG. 6, the present invention can be seen in cross section illustrating the manner in which it operates when the motor 22 is activated to turn the turbine 18. The motor assembly 22 includes a housing 140 and a motor 142 mounted therein by a motor mount 144. The motor 142 includes and output shaft 146 which is operably coupled to a gearbox 148. The gearbox 148 is of a conventional type and includes an electrical throw out clutch such that when the motor 142 is not energized the output shaft 146 is permitted to freewheel. The output of the gearbox 148 is coupled to the turbine 18 by a shaft which, in conjunction with a bushing 52 rotatably mounts the turnbine 18. Power is supplied to the motor 142 and the throw out clutch of the gearbox 148 by the cable 26 which extends downwardly therefrom to a remote location selected by the user. The cable 26 enters a remotely located control panel 154 having an on-off switch 156 operably connected between the cable 26 and a power cord 158 having a conventional plug 160. When the plug 160 is placed in a suitable power receptacle, and the switch 156 is placed in the ON position, power is sent through the cable 26 to the motor 142 and to the gearbox 148 to activate the motor 142 and to engage the throw out clutch in the gearbox 148. When the switch 156 is placed in an OFF position, the motor 142 ceases operation and the throw out clutch disengages to permit freewheeling of the turbine 18 if it is subjected to wind. The gearbox 148 may also include a remotely operated lock which would fix the shaft 150 in position so that the turbine 18 could not freewheel. This might be useful on very cold days when it would not be desirable for the vanes 28 and 30 to be opened by a pressure differential created by spinning of the turbine 18.

Of course, the motor assembly 22 does not have to be provided and the turbine 18 might merely be suspended by a suitable shaft and bushing arrangement without the option of a motor drive. Additionally, variously configured fans could be employed instead of the turbine 18 or in conjunction therewith to create a pressure differential on demand.

The temperature responsive assembly 60 may be fabricated from a bimetallic thermostat in lieu of the gaseous thermostat discussed. The bimetallic thermostat could be coupled directly to each of the vanes 28 and 30 and transmit the desired force to open the vanes 28 and 30 at predetermined temperatures as discussed above. In this embodiment the camming means and biasing means need not be utilized.

Although illustrative embodiments of the invention have been described in detail herein with reference to the accompanying drawings, it is to be understood that the invention is not limited to these precise embodiments, and that various changes and modifications may be effected therein without departing from the scope or spirit of the invention.

Having thus set forth the nature of the invention, what is claimed is:

1. An automatic temperature and pressure responsive damper assembly for use within the conduit of a ventilating system designed to exhaust air from a defined space into the atmosphere comprising:

(a) mounting means for mounting said damper assembly within said conduit;

(b) at least one vane pivotally mounted on said mounting means, said vane being movable between an open position wherein said vane permits the passage of air through said conduit and a closed position wherein said vane precludes the passage of air through said conduit;

(c) means for opening said vane when the temperature of the air in said defined space reaches a predetermined level, said opening means including;

(i) camming means secured to said vane and being carried by said mounting means and having a camming surface thereon, (ii) a temperature responsive drive assembly mounted to detect temperature changes of the air in said conduit, said drive assembly adapted to actuate in response to the temperature change within a predetermined range, and (iii) transmission means operably extending between said drive assembly and said camming surface of said camming means for communicating movement of said drive assembly to said camming means such that said vane is moved to varying positions in response to temperature changes of the air in said conduit;

(d) spring means biasing said vane to said closed position and opening said vane when there is a pressure differential of a predetermined magnitude between the end of said conduit in communication with said defined space and the end of said conduit in communication with said atmosphere, the pressure being greater at the end of said conduit in communication with said defined space; and (e) means for varying the degree which said vane opens when subjected to a pressure differential, said varying means including a weight movable in relation to the pivotal axis of said vane, said weight being movably affixed upon a surface of said vane to partially counteract the force applied by said spring means.

2. The apparatus as defined in claim 1, wherein said biasing means urges said camming means into contact with said transmission means in a direction opposite to the forces applied by said drive assembly so as to obtain an automatic closing of said vane irrespective of the mounting position of said conduit.

* * * * *